United States Patent [19]

King

[11] 3,983,528

[45] Sept. 28, 1976

[54] RESISTOR NETWORK WITH ADJUSTABLE RESISTANCE VALUE

[75] Inventor: William Clyde King, Helsinki, Finland

[73] Assignee: Oy Paramic AB, Helsinki, Finland

[22] Filed: June 17, 1975

[21] Appl. No.: 587,674

[30] Foreign Application Priority Data

June 18, 1974 · Finland ..... 1866/74

[52] U.S. Cl. ..... 338/195; 338/203; 338/320

[51] Int. Cl.[2] ..... H01C 10/00

[58] Field of Search ..... 338/203, 320, 195, 333, 338/334; 29/610–612

[56] References Cited

UNITED STATES PATENTS 2,052,533 8/1936 Pender ..... 338/203 X 2,382,024 8/1945 Priessman ..... 338/195

OTHER PUBLICATIONS

A.Bross et al. *Modular Resistor Array*, "IBM Technical Disclosure Bulletin," vol. 13 No. 5, p. 1105, Oct. 1970.

*Primary Examiner*—C. L. Albritton

*Attorney, Agent, or Firm*—Gifford, Chandler & Sheridan

[57] ABSTRACT

A substrate is provided with a plurality of parallel connected resistors separated by means permitting the substrate to be broken and the resistors removed so that by removal of an appropriate number of the resistors the resistance of the circuit can be increased to the desired value.

3 Claims, 2 Drawing Figures

RESISTOR NETWORK WITH ADJUSTABLE RESISTANCE VALUE

BACKGROUND OF THE INVENTION

I. Field of the Invention

The present invention is directed to an adjustable resistance resistor network from which circuit parts can be removed or disconnected in order to change the resistance value.

II. Description of the Prior Art

A resistor network of this type is disclosed in British Pat. No. 1,236,580. In this patent, resistance wires have been arranged in a given configuration on a substrate strip which can be rolled up, and the resistance value can be set as desired by interrupting connections between the resistance wires. This prior art resistor is intended to be used as a series or shunt resistor in electrical measuring instruments. In contrast, it is not usable at all in exacting electronic circuits, due to the fact that the resistor has a large size, while on the other hand the resistance values are small and the elastic substrate is unreliable.

In electronic circuits adjustable potentiometers are used for the purpose of trimming the circuits after assembly. Such potentiometers are most often of the slide contact type. Such trimmer potentiometers are not reliable enough in exacting electronic circuits and are susceptible to changes of their resistance value when the point of contact becomes oxidized.

SUMMARY OF THE INVENTION

The aim of the present invention is to provide an adjustable resistor network of the type mentioned which is sufficiently reliable for use even in the most exacting electronic circuits and with the aid of which the circuit is also trimmable after it has been assembled. This aim is achieved with the aid of an adjustable resistance resistor network.

DESCRIPTION OF THE DRAWING

In the following an embodiment example of the invention is more closely described with reference to the attached drawing, wherein.

DESCRIPTION OF A PREFERRED EMBODIMENT

Figure 1:
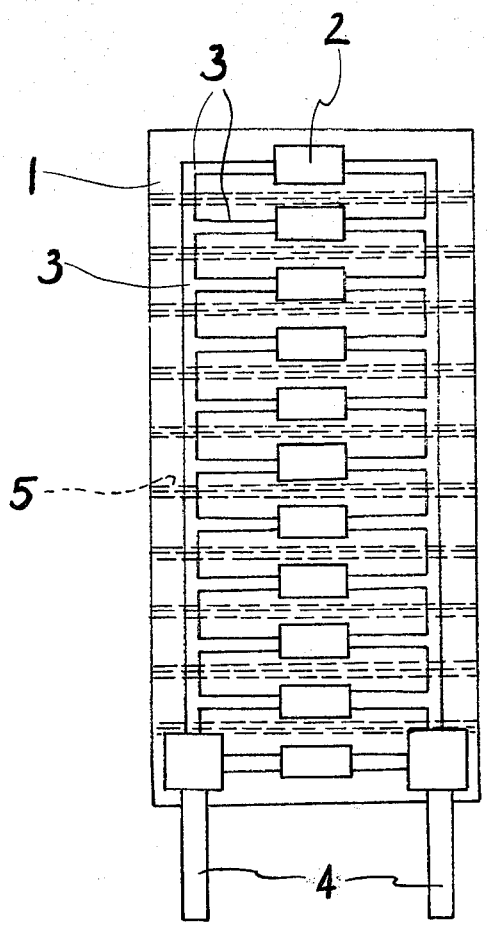
FIG. 1 presents a resistor network according to the invention in planar view.

On a hard insulating substrate 1, preferably of a ceramic material, a number of resistors 2 have been produced by the known film technique. The resistors 2 are connected in parallel by the aid of strips 3 of a conductive material. A set of resistors 2 connected in parallel thus lies between the binding posts 4. The substrate 1 has been provided with a weakened line 5 running from margin to margin between each adjacent pair of resistors. The weakened lines 5 may be located on the side opposite to the resistor network as shown in the drawings or if preferred they may be provided on the same side as the resistor network. By using appropriate pliers, or in the case of larger resistor networks by hand alone, the substrate 1 may be broken off bit by bit and thereby individual resistors 2 may be removed, causing the resistance across the binding posts 4 to increase.

Since there are no movable parts and no contact point resistances, the adjustable resistor of the invention is as reliable as a non-adjustable film resistor.

Figure 2:
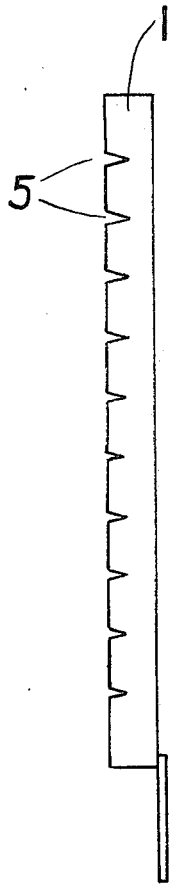
FIG. 2 is a side view of the network shown in FIG. 1 substantially as seen from the left hand side of FIG. 1.

If desired, the weakened lines 5 may be made such that they are grooves deepening in the upward direction as shown in FIG. 2, thus avoiding the risk of the substrate breaking off at the wrong point.

It is understood that the invention is not confined to the example presented, but that its structural details may vary within the scope of the claims following below. For instance, it is possible instead of the grooves 5 to use any kind of weakened lines, which have been produced by means of dividing partitions embedded in the substrate 1 or by reinforcing the substrate at the points other than those of the weakened lines. The configuration of the resistor network may also vary.

I claim:

1. An adjustable resistance resistor network comprising a plurality of individual resistors disposed on an insulating substrate, said resistors being connected together in parallel by strips of conductive material disposed on said insulating substrate, said substrate being provided with weakened lines which extend across said strips of conductive material between each adjacent pair of resistors whereby the substrate can be broken along said weakened lines to remove at least one of said resistors to thereby adjust the resistance value of said resistor network.

2. The resistor network according to claim 1, characterized in that the weakened lines are grooves.

3. The resistor network according to claim 1 characterized in the substrate comprises a ceramic material.

* * * * *